US009873177B2

(12) United States Patent
Kuno et al.

(10) Patent No.: US 9,873,177 B2
(45) Date of Patent: Jan. 23, 2018

(54) MACHINING APPARATUS

(71) Applicant: JTEKT CORPORATION, Osaka-shi, Osaka (JP)

(72) Inventors: Atsushi Kuno, Obu (JP); Kenji Ohgaki, Chiryu (JP); Fumikazu Hirakawa, Kashiba (JP)

(73) Assignee: JTEKT CORPORATION, Osaka-shi (JP)

( * ) Notice: Subject to any disclaimer, the term of this patent is extended or adjusted under 35 U.S.C. 154(b) by 71 days.

(21) Appl. No.: 15/044,860

(22) Filed: Feb. 16, 2016

(65) Prior Publication Data

US 2016/0250733 A1 Sep. 1, 2016

(30) Foreign Application Priority Data

Feb. 26, 2015 (JP) ..... 2015-036734

(51) Int. Cl.
*B24B 5/24* (2006.01)

(52) U.S. Cl.
CPC ..... *B24B 5/24* (2013.01)

(58) Field of Classification Search
CPC ..... B24B 5/24
USPC ..... 451/49, 5, 8–10, 331, 172
See application file for complete search history.

(56) References Cited

U.S. PATENT DOCUMENTS 1,886,579 A * 11/1932 Pew ..... B24B 5/245 451/189
2,586,987 A * 2/1952 Ortegren ..... B24B 5/24 451/164
2003/0236058 A1* 12/2003 Kamamura ..... B24B 5/01 451/49

FOREIGN PATENT DOCUMENTS

JP 2002-086341 A 3/2002

* cited by examiner

*Primary Examiner* — Robert Rose
(74) *Attorney, Agent, or Firm* — Oliff PLC

(57) ABSTRACT

A machining apparatus is of an in-feed type configured to machine an outer peripheral surface of a rotating tapered roller, and includes a rotating mechanism having a lateral pair of rollers on which the tapered roller is mounted, the rotating mechanism rotating the pair of rollers, and a grinding stone that is brought into contact with the outer peripheral surface of the tapered roller mounted on the pair of rollers. Each roller of the pair of rollers is shaped like a truncated cone. Small-diameter portions of the pair of rollers come into contact with a small-diameter portion of the tapered roller. Large-diameter portions of the pair of rollers come into contact with a large-diameter portion of the tapered roller.

18 Claims, 8 Drawing Sheets

MACHINING APPARATUS

INCORPORATION BY REFERENCE

The disclosure of Japanese Patent Application No. 2015-036734 filed on Feb. 26, 2015 including the specification, drawings and abstract, is incorporated herein by reference in its entirety.

BACKGROUND OF THE INVENTION

1. Field of the Invention

The invention relates to a machining apparatus for super-finishing an outer peripheral surface of a rotating tapered roller.

2. Description of the Related Art

A tapered roller for use as a rolling element for a rolling bearing is produced by shaping through grinding and then super-finishing an outer peripheral surface of the tapered roller, which serves as a rolling surface. As an apparatus used for the super-finishing, a through-feed machining apparatus has been known (see, for example, FIG. 1 in Japanese Patent Application Publication No. 2002-86341 (JP 2002-86341 A). This machining apparatus includes a pair of drums on which a plurality of tapered rollers is mounted in juxtaposition. With the tapered rollers fed on and along the rotating drums, the outer peripheral surfaces of the tapered rollers are super-finished by a grinding stone.

When workpieces such as rolling elements (tapered rollers) for rolling bearings are mass-produced, the above-described through-feed machining apparatus, which has actually demonstrated high performance, enables the workpieces to be efficiently super-finished. However, when a large variety of workpieces to be machined (tapered rollers) are produced in small lots, the through-feed machining apparatus is unsuitable for the production. This is partly because different drums are needed for the respective tapered rollers. In other words, each time the size of the tapered rollers is changed, the drums need to be changed and adjusted. However, the drums are long in its axial direction and heavy, and thus, the adjustment operation is difficult and takes long time.

For the through-feed machining apparatus, when surfaces of the drums are worn away with a long-term use, the surfaces need to be machined. In some through-feed machining apparatuses such as the one depicted in FIG. 9 and including a pair of drums 90 and 90, a spiral groove 92 is formed in each of the drums 90 and 90 in order to rotationally feed tapered rollers 91. In this case, when worn away with a long-term use, the grooves 92 need to be machined. Machining the grooves 92 needs a dedicated grinding machine, and disadvantageously, maintenance of the drums 90 is difficult.

When a large variety of tapered rollers are produced in small lots, an in-feed machining apparatus is preferably used instead of the through-feed machining apparatus. The in-feed machining apparatus includes a pair of rollers. A single tapered roller is mounted on the pair of rollers, which is then rotated to rotate the tapered roller. A grinding stone is brought into contact with an outer peripheral surface of the tapered roller. Thus, super-finishing is performed on the outer peripheral surface. When this machining is ended, the machined tapered roller is unloaded from the machining apparatus. The next tapered roller is loaded on the pair of rollers, and super-finishing is performed on the tapered roller.

In the in-feed machining apparatus as described above, while the tapered roller is rotating stably on the pair of rollers, the grinding stone correctly contacts the outer peripheral surface of the tapered roller to achieve super-finishing. However, when the rotating tapered roller performs an unstable behavior, the grinding stone may damage the outer peripheral surface of the tapered roller. Specifically, when a (sudden) slip occurs between the pair of rollers and the tapered roller, the grinding stone may damage the outer peripheral surface of the tapered roller.

SUMMARY OF THE INVENTION

An object of the invention is to suppress a (sudden) slip occurring between rollers and a tapered roller.

An aspect of the invention provides an in-feed machining apparatus configured to machine an outer peripheral surface of a rotating tapered roller. The machining apparatus includes a rotating mechanism having a lateral pair of rollers on which the tapered roller is mounted, the rotating mechanism rotating the pair of rollers and a grinding stone that is brought into contact with the outer peripheral surface of the tapered roller mounted on the pair of rollers. Each roller of the pair of rollers is shaped like a truncated cone. Small-diameter portions of the pair of rollers come into contact with a small-diameter portion of the tapered roller. Large-diameter portions of the pair of rollers come into contact with a large-diameter portion of the tapered roller.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
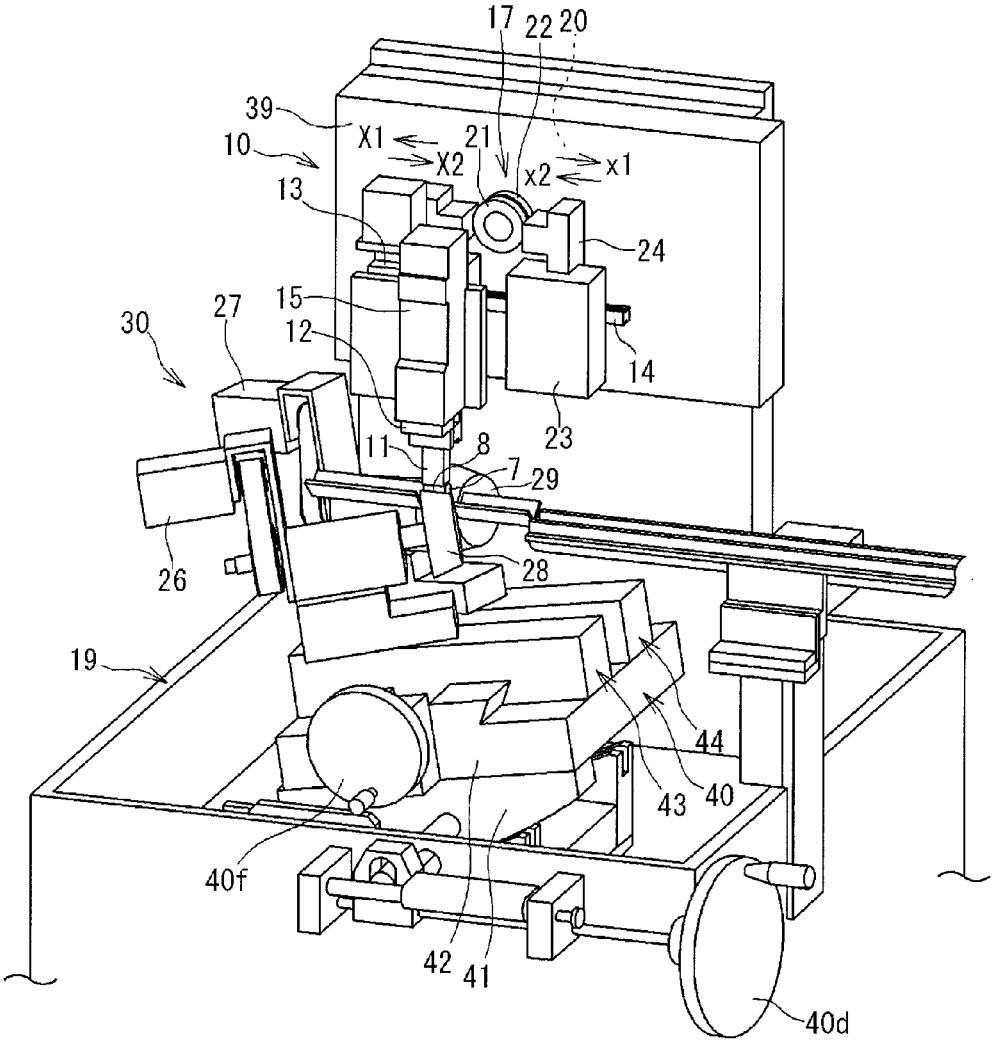
FIG. 1 is a perspective view depicting a part of an embodiment of a machining apparatus according to the invention.

An embodiment of the invention will be described below based on the drawings. FIG. 1 is a perspective view depicting an embodiment of a machining apparatus according to the invention. A machining apparatus 10 is an apparatus configured to super-finish a workpiece. In a case described in the present embodiment, the workpiece is a tapered roller 7 used as a rolling element for a tapered roller bearing.

The machining apparatus 10 presses and vibrates a grinding stone 11 against a conical outer peripheral surface (surface to be machined) 8 of the rotating tapered roller 7 to super-finish the outer peripheral surface 8. A direction in which the grinding stone 11 is vibrated is parallel to a generatrix at a portion of the outer peripheral surface 8 of the tapered roller 7, which contacts the grinding stone 11. In the present embodiment, the grinding stone 11 brought into contact with the outer peripheral surface 8 of the tapered roller 7 is configured to be shorter than the length of the outer peripheral surface 8 in the direction of the generatrix.

Components of the machining apparatus 10 are arranged such that a contact plane between the outer peripheral surface 8 of the tapered roller 7 and the grinding stone 11 is located horizontally. Thus, the vibrating direction of the grinding stone 11 is the horizontal direction and is defined as a front-rear direction. In the machining apparatus 10, as will be described later, a pair of rollers 28 and 29 is provided in juxtaposition so as to allow the tapered roller 7 to be mounted and rotated on the rollers 28 and 28. A direction in which the rollers 28 and 29 are arranged in juxtaposition is defined as a lateral direction. The front-rear direction and the lateral direction are orthogonal to each other in a horizontal plane. A direction orthogonal to the horizontal plane is an up-down direction.

The machining apparatus 10 depicted in FIG. 1 is an in-feed apparatus configured to machine the outer peripheral surface 8 of the rotating tapered roller 7. In other words, the single tapered roller 7 is loaded onto the rollers 28 and 29. Upon being super-finished, the tapered roller 7 is unloaded from a side opposite to a loading side. Then, the next tapered roller 7 is loaded onto the rollers 28 and 29. The direction in which the tapered roller 7 is loaded and unloaded corresponds to the front-rear direction.

The machining apparatus 10 includes a rotating mechanism 30, the grinding stone 11, an actuator 15, a vibrating mechanism 17, a fixed portion 19, and a table 40. The rotating mechanism 30 rotates the tapered roller 7. The grinding stone 11 contacts the outer peripheral surface 8 of the tapered roller 7. The actuator 15 presses the grinding stone 11 against the outer peripheral surface 8 of the tapered roller 7. The vibrating mechanism 17 vibrates the grinding stone 11 along the outer peripheral surface 8. The fixed portion 19 is in a fixed state with respect to a floor surface.

The vibrating mechanism 17 includes a frame 39, a motor 20, a first eccentric cam 21, and a first movable member 13. The frame 39 is mounted on the fixed portion 19. The first eccentric cam 21 is rotated by the motor 20. The motor 20 in the present embodiment is a servo motor. The grinding stone 11 is held by a wheel spindle stock 12. The wheel spindle stock 12 is attached to the actuator 15. The actuator 15 is attached to the first movable member 13. Thus, the grinding stone 11 and the wheel spindle stock 12 are mounted on the first movable member 13. The actuator 15 has a function to exert a thrust that presses the grinding stone 11 against the tapered roller 7. The actuator 15 is, for example, an electric cylinder.

The first movable member 13 is supported on the frame 39 such that the first movable member 13 can be linearly reciprocated by a guide portion 14. Rotary motion of the first eccentric cam 21 is converted into linear reciprocating motion of the first movable member 13. The first movable member 13 makes linear reciprocating motion in directions of arrows X1 and X2. Thus, the grinding stone 11 mounted on the first movable member 13 can be vibrated. A direction in which the first movable member 13 supported by the guide portion 14 is movable coincides with the vibrating direction of the grinding stone 11.

The vibrating mechanism 17 further includes a second eccentric cam 22, a counterweight 23, and a second movable member 24. The second eccentric cam 22 and the counterweight 23 are rotated by the motor 20. The counterweight 23 is attached to the second movable member 24. The second movable member 24 is supported on the frame 39 such that the second movable member 24 can be linearly reciprocated by the guide portion 14. Rotary motion of the second eccentric cam 22 is converted into linear reciprocating motion of the second movable member 24. Thus, the second movable member 24 linearly reciprocates in directions of arrows x1 and x2. Accordingly, the counterweight 23 linearly reciprocates integrally with the second movable member 24.

The first eccentric cam 21 and the second eccentric cam 22 have rotational phases that are 180 degrees different from each other. The counterweight 23 is linearly reciprocated by the second eccentric cam 22 in order to cancel vibration of the first movable member 13 on which the grinding stone 11 and the like are mounted.

Figure 2:
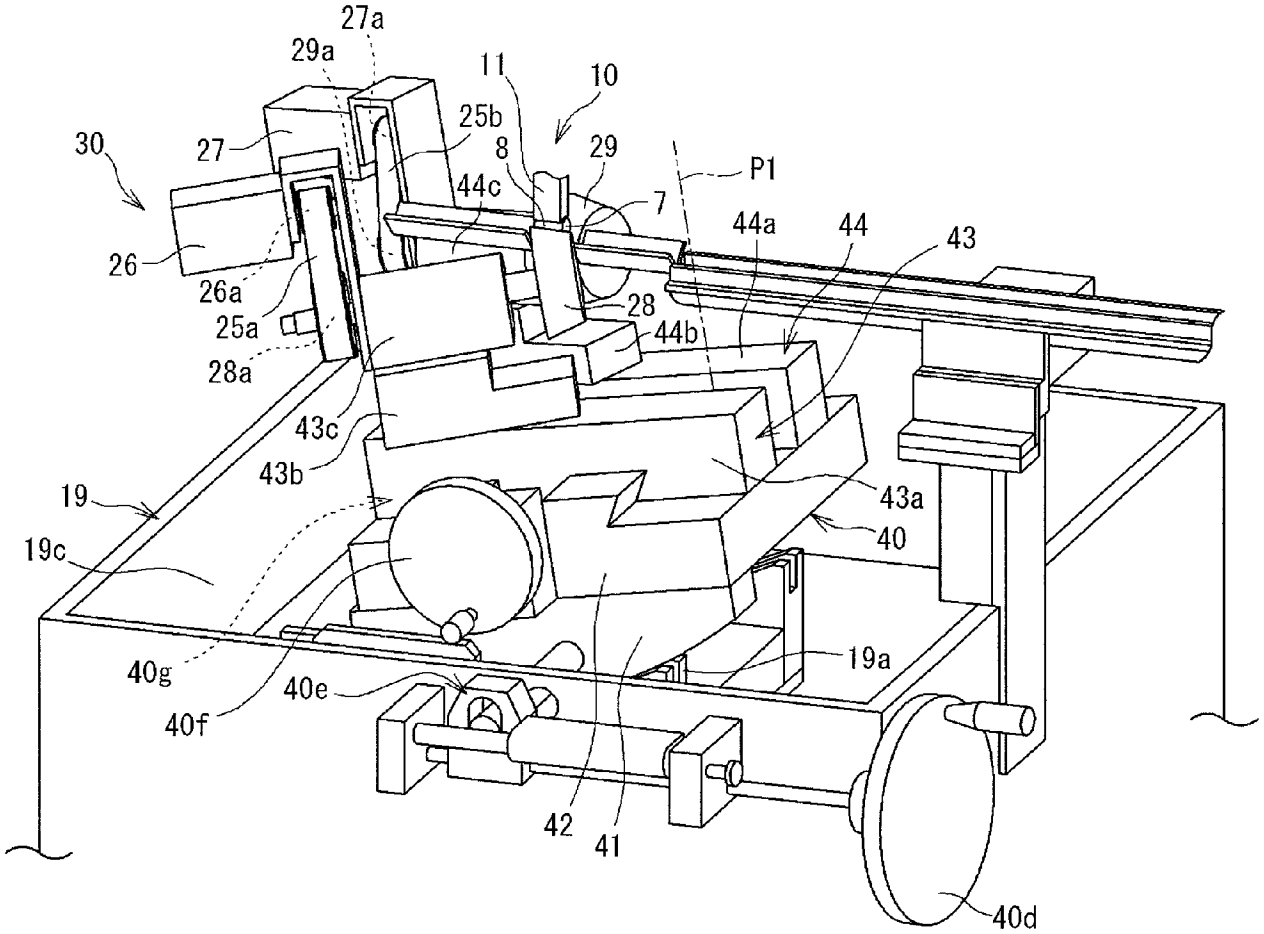
FIG. 2 is a perspective view depicting a part of the machining apparatus depicted in FIG. 1.

The rotating mechanism 30 has a pair of rollers 28 and 29 and a pair of motors 26 and 27. The rollers 28 and 29 are provided on the right and left sides of the machining apparatus 10 in juxtaposition at the same height. FIG. 2 is a perspective view depicting a part of the machining apparatus 10 depicted in FIG. 1. In FIG. 2, an output shaft 26*a* of the first motor 26 and a shaft 28*a* of the roller 28 are coupled together by a power transmission member 25*a* such as a belt. An output shaft 27*a* of the second motor 27 and a shaft 29*a* of the roller 29 are coupled together by a power transmission member 25*b* such as a belt. The coupling between the output shaft 26*a* and the shaft 28*a* and the coupling between the output shaft 27*a* and the shaft 29*a* may be established by bringing gears provided on the two shafts into meshing engagement with each other.

The roller 28 and the roller 29 have the same shape. In the present embodiment, both the rollers 28 and 29 are shaped like truncated cones. The rollers 28 and 29 are arranged with respect to the tapered roller 7 such that the outer peripheral surface 8 of the tapered roller 7 is in linear contact with an outer peripheral surface of each of the rollers 28 and 29. The rollers 28 and 29 are made of steel, for example, SUJ2.

The tapered roller 7 is positioned on and between the rollers 28 and 29 and supported from below. The grinding stone 11 is in contact with the tapered roller 7 from above. The rollers 28 and 29 are driven and rotated by the motors 26 and 27. Thus, the tapered roller 7 can rotate around the center of the tapered roller 7. During super-finishing, the grinding stone 11 is pressed by the actuator 15 (see FIG. 1) against the tapered roller 7 rotating on the rollers 28 and 29. The rollers 28 and 29 rotate at a constant speed. The motors 26 and 27 in the present embodiment are servo motors.

The fixed portion 19 has a frame member 19*c* on which the table 40, the vibrating mechanism 17 (see FIG. 1), and the like are mounted. The table 40 is supported by the frame member 19*c* so as to be able to swing forward and rearward around the tapered roller 7. In other words, the frame member 19*c* (fixed portion 19) has a guide member 19*a* that guides a circular-arc base 41 provided on the table 40. A lower surface of the circular-arc base 41 has a circular arc shape centered around a swing centerline of the table 40. The table 40 is swung around an imaginary line in the lateral direction. In other words, a swing centerline P0 (see FIG. 3) of the table 40 is a straight line extending in the lateral direction.

In FIG. 2, the table 40 has the circular-arc base 41, a main body base 42, a first support portion 43 on the right, and a second support portion 44 on the left. The circular-arc base 41 is guided by the guide member 19*a*. The main body base 42 is integrated with the circular-arc base 41. The first support portion 43 on the right is provided on the main body base 42. The second support portion 44 on the left is provided on the main body base 42. As will be described later, the support portions 43 and 44 support the rollers 28 and 29 so that the rollers 28 and 29 are rotatable and can be displaced relative to each other. The first support portion 43 has a first support main body portion 43*a*, and a first installation member 43*b* provided on the first support main body portion 43*a*. Moreover, a bearing portion 43*c* is installed on the first installation member 43*b* to support the roller 28 so that the roller 28 is rotatable. The second support portion 44 has a first support main body portion 44*a*, and a second installation member 44*b* provided on the first support main body portion 44*a*. Moreover, a bearing portion 44*c* is installed on the second installation member 44*b* to support the roller 29 so that the roller 29 is rotatable.

The table 40 can swing around the swing centerline P0 (see FIG. 3) with respect to the fixed portion 19 and can be fixed at a predetermined swing position. Thus, the tilt angles θv of centerlines L1 and L2 (see FIG. 3) of the rollers 28 and 29 are changeable. Each of the rollers 28 and 29 can be fixed at a predetermined tilt angle θv. The tilt angle of the centerline L1 of the roller 28 has the same value (θv) as that of the tilt angle of the centerline L2 of the roller 29. The tilt angle θv is the angle of each centerline L1 (L2) with respect to a horizontal line, in a vertical plane containing the centerline L1 (L2).

In FIG. 2, swinging of the table 40 rotates a handle 40*d* supported by the frame member 19*c*. Thus, the swinging can be performed via a link mechanism 40*e* including a worm gear. A self-lock function of the worm gear enables the table 40 to be fixed (locked) at a predetermined swing position. Thus, a configuration that enables a change in the swing position of the table 40 with respect to the frame member 19*c* (fixed portion 19) serves as a mechanism that allows adjustment of relative positions between the tapered roller 7 and the rollers 28 and 29.

Figure 3:
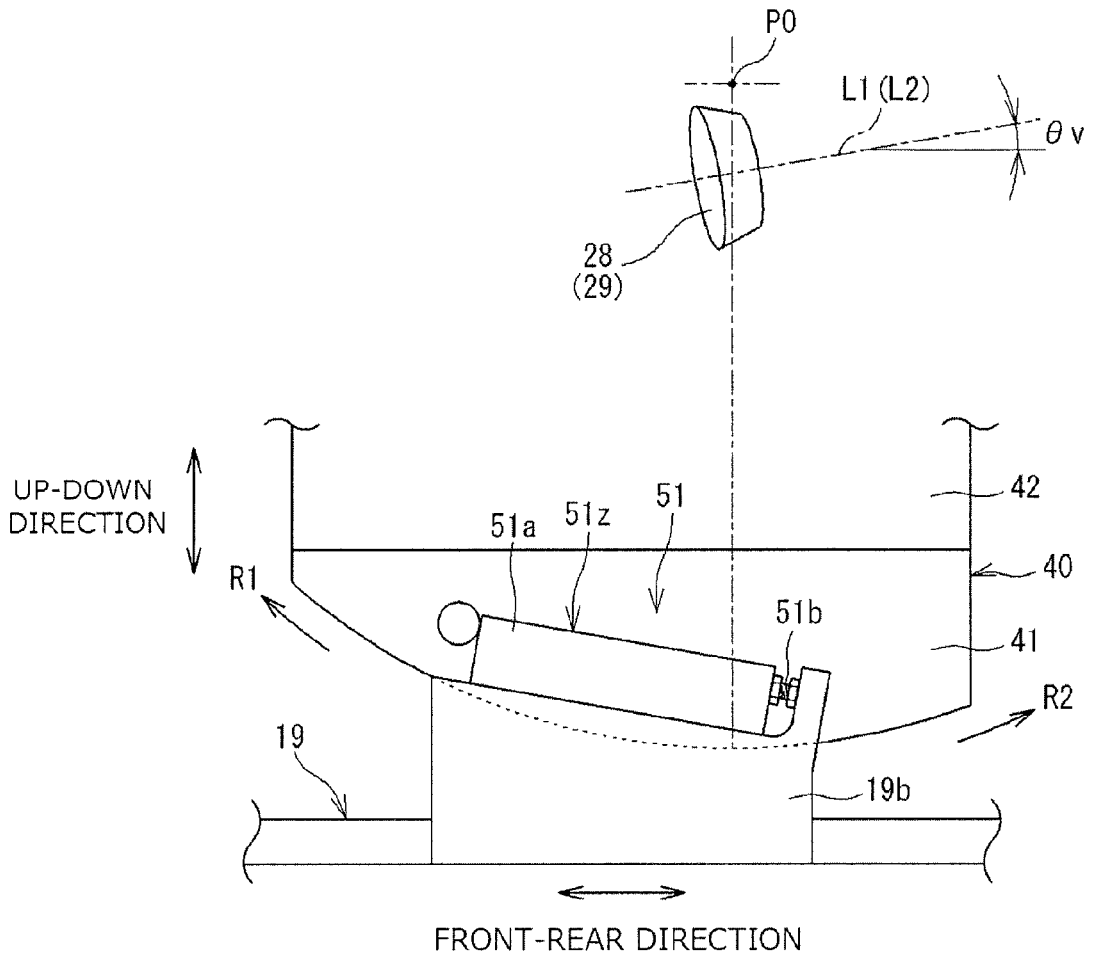
FIG. 3 is a side view illustrating operations of a table with respect to a fixed portion.

As depicted in FIG. 3, to facilitate adjustment of the swing position of the table 40 with respect to the fixed portion 19, namely, the tilt angle θv of each of the centerlines L1 and L2 of the rollers 28 and 29, the machining apparatus 10 includes a first adjustment portion 51 configured to adjust the swing position of the table 40 with respect to the fixed portion 19. FIG. 3 is a diagram illustrating the first adjustment portion 51.

The first adjustment portion 51 of the present embodiment has an adjustment unit 51*z* that can be extended and contracted. The adjustment unit 51*z* is interposed between a fixed member 19*b* of the fixed portion 19 (frame member 19*c*) and a part of the circular-arc base 41 of the table 40. The adjustment unit 51*z* has a main body portion 51*a* and a threaded member 51*b* that is screw-threaded in a threaded hole formed in the main body portion 51*a*. Rotating the threaded member 51*b* allows a change in a protruding distance by which the threaded member 51*b* protrudes from the main body portion 51*a*. Consequently, the overall length of the adjustment unit 51*z* is changed (that is, the adjustment unit 51*z* is extended or contracted). In order to extend the adjustment unit 51*z* in a state depicted in FIG. 3, the frame 40 needs to be swung in the direction of arrow R1 with respect to the fixed portion 19. In contrast, contracting the adjustment unit 51*z* allows the frame 40 to be swung in the direction of arrow R2 with respect to the fixed portion 19. The length of the adjustment unit 51*z* and the angle of the frame 40 have a one-to-one relationship. Thus, setting the adjustment unit 51*z* to a predetermined length determines a single value for the angle of the frame 40 with respect to the fixed portion 19. As a result, a single value is also determined for the tilt angle θv of each of the centerlines L1 and L2 of the rollers 28 and 29 mounted on the frame 40.

For example, in the state depicted in FIG. 3, the adjustment unit 51*z* is contracted to set the adjustment unit 51*z* to a predetermined length and the handle 40*d* (see FIG. 2) is rotated so that a distance between a part of the fixed portion 19 (fixed member 19*b*) and a part of the table 40 (circular-arc base 41) is equal to the predetermined length of the adjustment unit 51*z*. This makes the table 40 unable to swing, limiting rotation of the handle 40*d*. As a result, each of the centerlines L1 and L2 of the rollers 28 and 29 has the tilt angle θv corresponding to the predetermined length of the adjustment unit 51*z*. As described above, the first adjustment portion 51 has the tilting adjustment unit 51*z* that enables adjustment of the distance between the part of the fixed portion 19 (fixed member 19*b*) and the part of the table 40 (circular-arc base 41). Thus, the tilts of the rollers 28 and 29 are easily adjusted.

With reference back to FIG. 2, the first support main body portion 43*a* of the first support portion 43 and the second support main body portion 44*a* of the second support portion 44 are movable in the lateral direction and can be fixed at predetermined positions in the lateral direction. The roller 28 and the roller 29 are mounted on the first support main body portion 43*a* and the second support main body portion 44*a*, respectively. Thus, the first support main body portion 43*a* and the second support main body portion 44*a* are moved in the lateral direction so that the distance between the rollers 28 and 29 in the lateral direction can be changed and the rollers 28 and 29 can be fixed at changed positions. Rotating a handle 40*f* allows the first support main body portion 43*a* and the second support main body portion 44*a* to be moved via the link mechanism 40*g* including the worm gear. Rotating the handle 40*f* in one direction moves the first support main body portion 43*a* and the second support main body portion 44*a* closer to each other. Rotating the handle 40*f* in the other direction moves the first support main body portion 43*a* and the second support main body portion 44*a* away from each other. The self lock function of the worm gear enables the first support main body portion 43*a* and the second support main body portion 44*a* to be fixed (locked) at a predetermined distance from each other. As described above, the configuration that enables a change in the distance B (see FIG. 4) between the first support main body portion 43*a* and the second support main body portion 44*a* serves as a mechanism configured to adjust the relative positions between the tapered roller 7 and the rollers 28 and 29.

Figure 4:
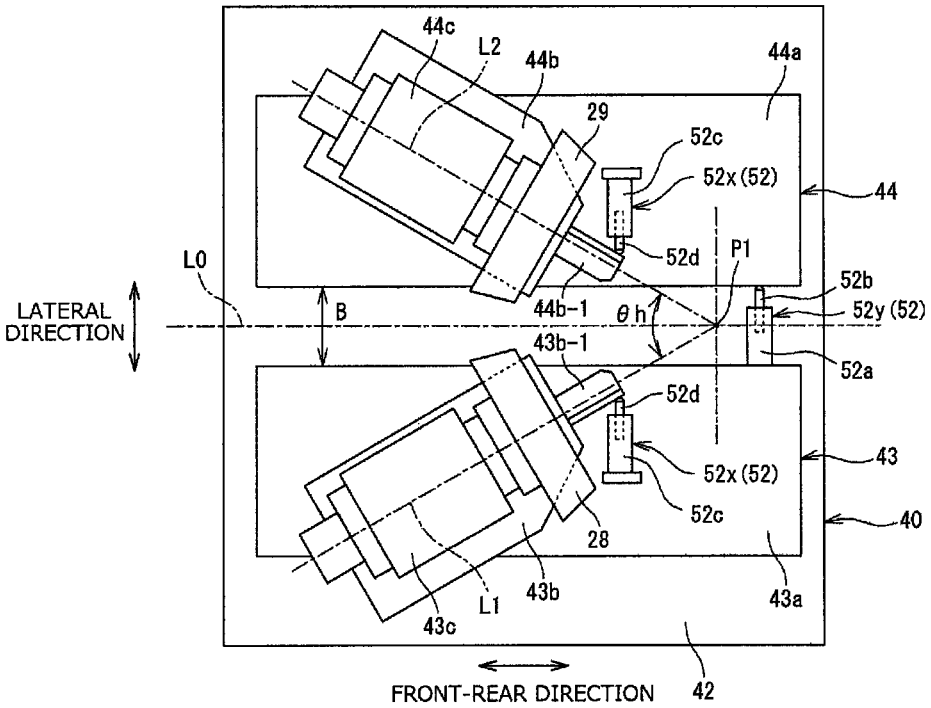
FIG. 4 is a diagram illustrating a second adjustment portion and depicting the table and the like as viewed in a direction orthogonal to centerlines of rollers.

As depicted in FIG. 4, to facilitate a change in the distance B between the first support main body portion 43*a* and the second support main body portion 44*a*, namely, a change in the distance between the rollers 28 and 29 in the lateral direction, the machining apparatus 10 includes a second adjustment portion 52 configured to adjust a relative position between the rollers 28 and 29 on the table 40. FIG. 4 is a diagram illustrating the second adjustment portion 52 and depicting the table 40 and the like as viewed in a direction orthogonal to the centerline L1 (L2) of the roller 28 (29) (that is, viewed from above).

The second adjustment portion 52 in the present embodiment has an adjustment unit 52*y* that can be extended and contracted. The adjustment unit 52*y* is interposed between the first support main body portion 43*a* of the first support portion 43 and the second support main body portion 44*a* of the second support portion 44. The adjustment unit 52*y* has a main body portion 52*a* and a threaded member 52*b*. The threaded member 52*b* is screw-threaded in a threaded hole formed in the main body portion 52*a*. Rotating the threaded member 52*b* changes the protruding distance by which the threaded member 52*b* protrudes from the main body portion 52*a*. Thus, the overall length of the adjustment unit 52*y* is changed (that is, the adjustment unit 52*y* is extended or contracted). In order to extend the adjustment unit 52*y* in a state depicted in FIG. 4, the distance between the first support main body portion 43*a* and the second support main body portion 44*a* needs to be increased. In contrast, contracting the adjustment unit 52*y* enables a reduction in the distance B between the first support main body portion 43*a* and the second support main body portion 44*a*. The length of the adjustment unit 52*y* and the distance B between the first support main body portion 43*a* and the second support main body portion 44*a* have a one-to-one relationship. Thus, setting the adjustment unit 52*y* to a predetermined length determines a single value for the distance B between the first support main body portion 43*a* and the second support main body portion 44*a*. As a result, a single value is also determined for a lateral distance between the rollers 28 and 29 mounted on the first support main body portion 43*a* and the second support main body portion 44*a*.

For example, in the state depicted in FIG. 4, the adjustment unit 51*y* is contracted so as to set the adjustment unit 51*y* to a predetermined length, and the handle 40*f* (see FIG. 2) is rotated. The distance B between the first support main body portion 43*a* and the second support main body portion 44*a* becomes equal to the predetermined length of the adjustment unit 52*y*. This makes the first support main body portion 43*a* and the second support main body portion 44*a* immovable, limiting rotation of the handle 40*f*. As a result, a lateral distance corresponding to the predetermined length of the adjustment unit 52*y* is set between the rollers 28 and 29.

In the present embodiment, for the relative position between the rollers 28 and 29, the lateral distance between the rollers 28 and 29 can be adjusted, as described above. The second adjustment portion 52 has the distance adjustment unit 52*y* that enables adjustment of the distance (distance B) between the first support main body portion 43*a* of the first support portion 43 and the second support main body portion 44*a* of the second support portion 44. This facilitates adjustment of the distance between the rollers 28 and 29.

The first installation member 43*b* is provided over the first support main body portion 43*a* so as to be able to swing around a predetermined swing centerline P1 and to be fixed at a predetermined swing position. The swing centerline P1 is a straight line that is orthogonal to the centerline L1 (L2) of the roller 28 (29) and that extends along an imaginary vertical plane. The roller 28 is installed on the first installation member 43*b* via the bearing portion 43*c*. The first installation member 43*b* and the roller 28 are integrated together. Similarly, a second installation member 44*b* provided over the second support main body portion 44*a* so as to be able to swing around the predetermined swing centerline P1 and to be fixed at a predetermined swing position. The roller 29 is installed on the second installation member 44*b* via the bearing portion 44*c*. The second installation member 44*b* and the roller 29 are integrated together. Consequently, an angle θh between the centerlines L1 and L2 of the rollers 28 and 29 is changeable, and the rollers 28 and 29 can be fixed at the changed angle θh. The fixation can be achieved by, for example, tightening a bolt not depicted in the drawings. Thus, the configuration that enables a change in the angle formed between the first installation member 43*b* and the second installation member 44*b*, namely, the angle θh between the centerlines L1 and L2 of the rollers 28 and 29, serves as a mechanism configured to adjust the relative positions between the tapered roller 7 and the rollers 28 and 29.

In FIG. 4, in order to facilitate a change in the angle θh between the centerlines L1 and L2 of the rollers 28 and 29, the machining apparatus 10 has, as the second adjustment portion 52, adjustment units 52*x* that can be extended and contracted, in addition to the adjustment unit 52*y*. The second adjustment portion 52 adjusts the relative position between the rollers 28 and 29 on the table 40. The adjustment unit 52*x* is interposed between a protruding piece 43*b*-1 of the first installation member 43*b* and the first support main body portion 43*a*, which is a part of the table 40. On the opposite side from the first support main body portion 43*a* in the lateral direction, the adjustment unit 52*x*, which can be extended and contracted, is also interposed between a protruding piece 44*b*-1 of the second installation member 44*b* and the second support main body portion 44*a*, which is a part of the table 40.

Each of the adjustment units 52*x* has a main body portion 52*c* and a threaded member 52*d*. The main body portion 52*c* is fixed to the first support main body portion 43*a* (44*a*). The threaded member 52*d* is screw-threaded in a threaded hole formed in the main body portion 52*c*. Rotating the threaded member 52*d* changes the protruding distance by which the threaded member 52*d* protrudes from the main body portion 52*c*. Thus, the overall length of the adjustment unit 52*x* is changed (that is, the adjustment unit 52*x* extended or contracted).

In order to extend the adjustment unit 52*x* in the state depicted in FIG. 4, the angle of the installation member 43*b* (44*b*) with respect to a reference line LO in the front-rear direction needs to be increased. In contrast, contracting the adjustment unit 52*x* enables a reduction in the angle of the installation member 43*b* (44*b*) with respect to the reference line LO in the front-rear direction. The length of the adjustment unit 52*x* and the angle of the installation member 43*b* (44*b*) with respect to the reference line LO have a one-to-one relationship. Thus, setting the adjustment unit 52*x* to a predetermined length determines a single value for the angle of the installation member 43*b* (44*b*) with respect to the reference line LO (θh/2). As a result, a single value is also determined for the angle θh between the centerlines L1 and L2 of the rollers 28 and 29 integrated with the first installation member 43*b* and the second installation member 44*b*.

For example, in the state depicted in FIG. 4, the right and left adjustment units 52*x* are contracted so as to set the right and left adjustment units 52*x* to a predetermined length, and the installation member 43*b* (44*b*) is swung to bring the protruding piece 43*b*-1 (44*b*-1) into abutting contact with a tip of the threaded member 52*d*. This makes the installation member 43*b* (44*b*) immovable and determines a single value for the angle (θh/2) of the installation member 43*b* (44*b*). As a result, the rollers 28 and 29 are set at the angle (θh/2) corresponding to the predetermined length of the adjustment unit 52*x*. Thus, the angle (θh) between the centerlines L1 and L2 of the rollers 28 and 29 is set.

Thus, in the present embodiment, for the relative position between the rollers 28 and 29, the relative angle between the rollers 28 and 29 (the angle θh between the centerlines L1 and L2) can be adjusted, as described above. The second adjustment portion 52 has the angular adjustment units 52*x* that enable adjustment of a swing angle of the first installation member 43*b* and a swing angle of the second installation member 44*b*. This facilitates adjustment of the relative angle (θh) between the rollers 28 and 29.

In the machining apparatus 10 configured as described above, when the size (bearing number) of the tapered roller 7 is changed, the arrangement of the rollers 28 and 29 needs to be changed in accordance with the resultant shape of the tapered roller 7 in order to bring the tapered roller 7 and the rollers 28 and 29 into linear contact with one another. Thus, even when the arrangement of the rollers 28 and 29 is changed, the machining apparatus 10 in the present embodiment swings the table 40 with the rollers 28 and 29 mounted thereon with respect to the fixed portion 19, and allows the first adjustment portion 51 (tilting adjustment unit 51*z*) to adjust the swing position of the table 40. Then, the tilts (θv: see FIG. 3) of the rollers 28 and 29 are set. Moreover, on the table 40, the second adjustment portion 52 (the angular adjustment units 52*x* and the distance adjustment unit 52*y*) are used to adjust the relative positions among the components of the support portions 43 and 44. Subsequently, the relative position between the rollers 28 and 29 on the support portions 43 and 44 is set.

Besides a change of the size (bearing number) of the tapered roller 7, wear of the outer peripheral surfaces of the rollers 28 and 29 may occur with a long-term use (uneven wear). In this case, to bring the tapered roller 7 into linear contact with the rollers 28 and 29, maintenance needs to be performed on the rollers 28 and 29. For example, outer peripheral surfaces of the rollers 28 and 29 need to be ground, and the arrangement of the rollers 28 and 29 accordingly needs to be changed. Thus, even when such maintenance is performed on the rollers 28 and 29, the machining apparatus 10 in the present embodiment swings the table 40 with the rollers 28 and 29 mounted thereon with respect to the fixed portion 19, and allows the first adjustment portion 51 (tilting adjustment unit 51*z*) to adjust the swing position of the table 40. Then, the tilts (θv: see FIG. 3) of the rollers 28 and 29 are set. Moreover, on the table 40, the second adjustment portion 52 (the angular adjustment units 52*x* and the distance adjustment unit 52*y*) is used to adjust the relative positions among the components of the support portions 43 and 44. Subsequently, the relative position between the rollers 28 and 29 on the support portions 43 and 44 (the lateral distance between the rollers 28 and 29 and θh: see FIG. 4) may be set.

The degrees of the adjustments, that is, displacements of the rollers 28 and 29, may be determined through geometric calculations according to the size of a new tapered roller 7 and the shapes of the ground rollers 28 and 29. A specific example will be described below. As described above, even with a change of the size of the tapered roller 7 or after maintenance of the rollers 28 and 29, the machining apparatus 10 can easily set the tilts of the rollers 28 and 29 and the relative position between the rollers 28 and 29. The machining apparatus 10 can quickly resume machining of the tapered roller 7.

Figure 5:
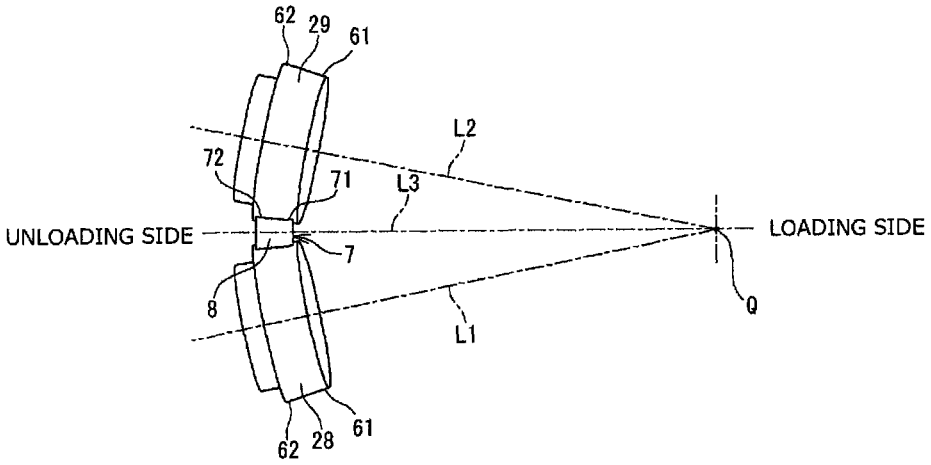
FIG. 5 is a plan view depicting rollers on which a tapered roller is mounted.

The outer peripheral surface 8 of the tapered roller 7 is shaped like a truncated cone. During machining performed by the machining apparatus 10, as depicted in FIG. 5, the small diameter side of the tapered roller 7 is positioned on an unloading side thereof (the right side in FIG. 5), whereas the large diameter side of the tapered roller 7 is positioned on a loading side thereof (the left side in FIG. 5). The rollers 28 and 29 on which the tapered roller 7 is mounted have truncated-cone-shaped outer peripheral surfaces. The small diameter side of each of the rollers 28 and 29 is positioned on the unloading side of the tapered roller 7 (the right side in FIG. 5), whereas the large diameter side of each of the rollers 28 and 29 is positioned on the loading side of the tapered roller 7 (the left side in FIG. 5). The outer peripheral surface 8 of the tapered roller 7 is positioned between the right and left rollers 28 and 29 and in linear contact with the rollers 28 and 29. The rollers 28 and 29 support the tapered roller 7 from below. The centerlines L1 and L2 of the rollers 28 and 29 cross each other at one point (Q). A centerline L3 of the tapered roller 7 in linear contact with the rollers 28 and 29 crosses the centerlines L1 and L2 at the point Q where the centerlines L1 and L2 cross each other. The grinding stone 11 is pressed against the tapered roller 7 from above (see FIG. 1). An area formed between the grinding stone 11 and the rollers 28 and 29 is narrowed toward the unloading side (the right side in FIG. 1). This regulates movement of the tapered roller 7 toward the unloading side. When the machined tapered roller 7 is unloaded rightward in FIG. 1, the grinding stone 11 moves upward. Thus, the tapered roller 7 can be unloaded.

Figure 6:
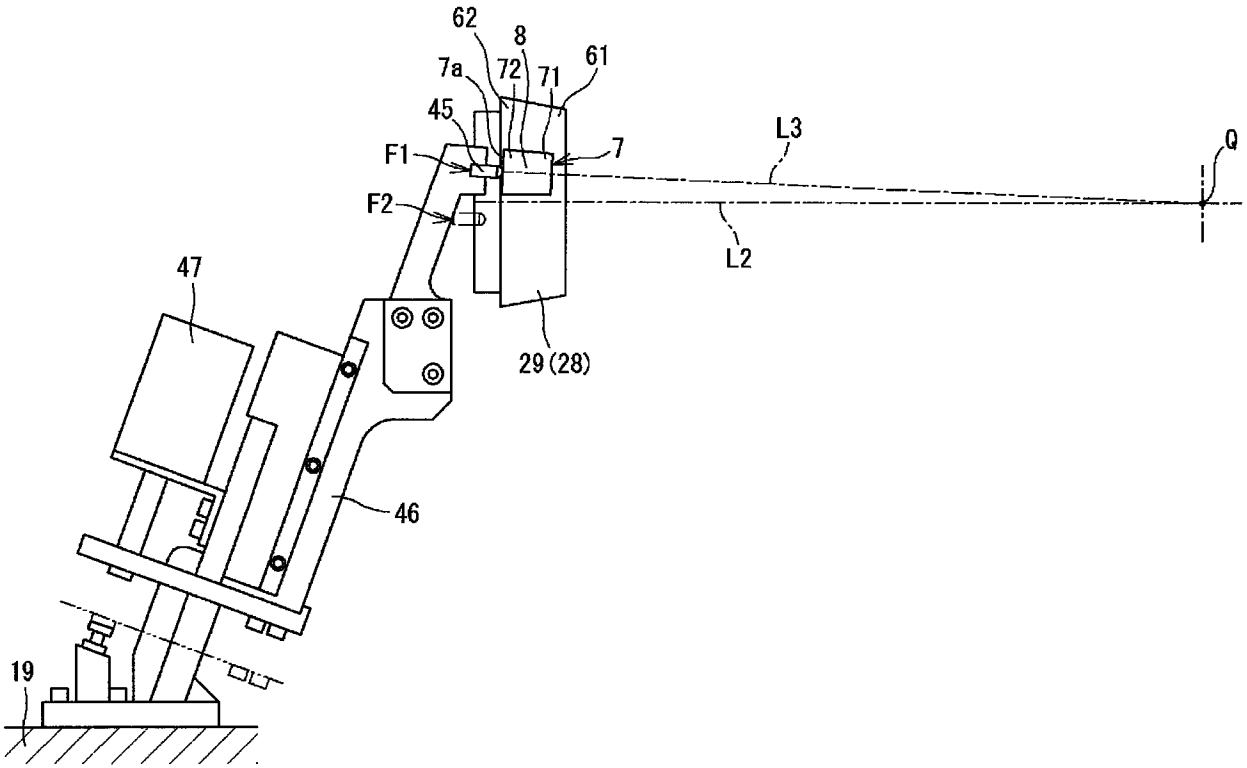
FIG. 6 is a side view depicting the rollers on which the tapered roller is mounted.

As depicted in FIG. 6, the machining apparatus 10 further includes a positioning portion 45 that prevents the tapered roller 7 from being displaced toward the loading side (the left side in FIG. 1) during machining. The positioning portion 45 can come into contact with a large end face 7*a* of the tapered roller 7 to position the tapered roller 7 in an axial direction. A tip of the positioning portion 45 can come into contact with the center of the large end face 7*a*, which is circular. The positioning portion 45 is attached to a column portion 46. The column portion 46 is supported so as to be movable in a height direction with respect to the fixed portion 19.

The machining apparatus 10 further includes an actuator (moving means) 47 that moves the column portion 46 in the height direction. Operations of the actuator 47 allow the column portion 46 to be elevated and lowered. Thus, the positioning portion 45 can be elevated and lowered. Specifically, the actuator 47 enables the positioning portion 45 to move between a machining position F1 and a retraction position F2. In the machining position F1, the positioning portion 45 can be brought into contact with the large end face 7*a*. The retraction position F2 is located below the machining position F1 and away from the tapered roller 7.

In this configuration, with the grinding stone 11 in contact with the tapered roller 7 positioned on the rollers 28 and 29 such that the grinding stone 11 is located on the opposite side (upper side) of the tapered roller 7 from the rollers 28 and 29. Consequently, the tapered roller 7 can be stabilized. In this state, the outer peripheral surface (surface to be machined) 8 of the tapered roller 7 is super-finished. Once the super-finishing is ended, the positioning portion 45 is placed in the retraction position F2. Then, the next tapered roller 7 to be machined can be positioned on the rollers 28 and 29.

As described above, each of the rollers 28 and 29 is shaped like a truncated cone and is brought into linear contact with the outer peripheral surface 8 of the tapered roller 7 (see FIG. 5 and FIG. 6). The small-diameter portion of each of the rollers 28 and 29 (hereinafter referred to as a roller small-diameter portion 61) comes into contact with the small-diameter portion of the tapered roller 7 (hereinafter referred to as a workpiece small-diameter portion 71). The large-diameter portion of each of the rollers 28 and 29 (hereinafter referred to as a roller large-diameter portion 62) comes into contact with the large-diameter portion of the tapered roller 7 (hereinafter referred to as a workpiece large-diameter portion 72). The rollers 28 and 29 are arranged with respect to the tapered roller 7 as described above.

In this configuration, a possible sudden slip between the tapered roller 7 and the rollers 28 and 29 can be suppressed. This effect will be described below.

In the rotating roller 28 (29), a peripheral velocity on the outer peripheral surface varies between the roller small-diameter portion 61 and the roller large-diameter portion 62, which differ from each other in diameter. In the rotating tapered roller 7, a peripheral velocity on the outer peripheral surface varies between the workpiece small-diameter portion 71 and the workpiece large-diameter portion 72, which differ from each other in diameter. Specifically, in the rotating roller 28 (29), a peripheral velocity $V_{62}$ on the outer peripheral surface of the roller large-diameter portion 62 is higher than a peripheral velocity $V_{61}$ on the outer peripheral surface of the roller small-diameter portion 61 ($V_{62}>V_{61}$). In the rotating tapered roller 7, a peripheral velocity $V_{72}$ on the outer peripheral surface of the workpiece large-diameter portion 72 is higher than a peripheral velocity $V_{71}$ on the outer peripheral surface of the workpiece small-diameter portion 71 ($V_{72}>V_{71}$). The roller large-diameter portion 62 with the high peripheral velocity is brought into contact with the workpiece large-diameter portion 72, out of the tapered roller 7, with the high peripheral velocity. The roller small-diameter portion 61 with the low peripheral velocity is brought into contact with the workpiece small-diameter portion 71 with the low peripheral velocity. Thus, the difference in peripheral velocity between the roller 28 (29) and the tapered roller 7 can be reduced. The difference in peripheral velocity between the roller 28 (29) and the tapered roller 7 can be set to zero by setting the roller 28 (29) to a preset shape according to the shape of the tapered roller 7, which will be described later. In other words, the peripheral velocity of the roller 28 (29) and the peripheral velocity of the tapered roller 7 can be adjusted and made equal to each other at the corresponding portions of the roller 28 (29) and the tapered roller 7. This enables a sudden slip between the roller 28 (29) and the tapered roller 7 to be suppressed.

A sudden slip between the roller 28 (29) and the tapered roller 7 makes the contact between the tapered roller 7 and the grinding stone 11 unstable. Consequently, a flaw (streak) may occur in the outer peripheral surface 8 of the tapered roller 7. However, the configuration in the present embodiment can reduce occurrence of flaws.

Figure 7:
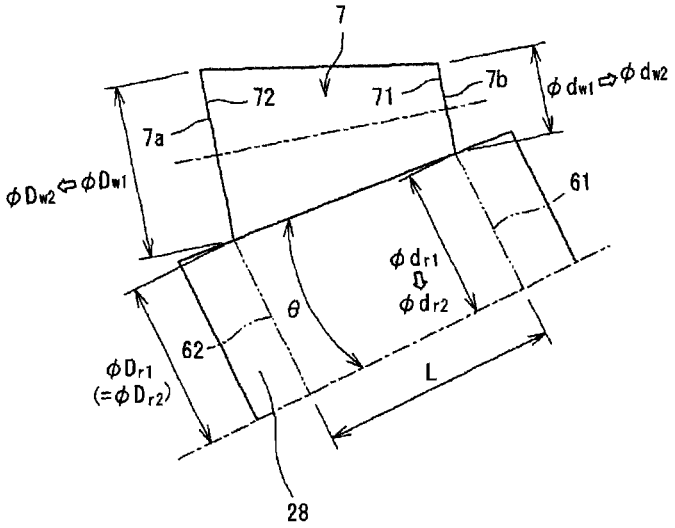
FIG. 7 is a diagram for illustrating the tapered roller and the rollers on which the tapered roller is mounted.

Setting of the shape of the roller 28 (29) will be described. FIG. 7 is a diagram illustrating the tapered roller 7 and the roller 28. Since the roller 28 and the roller 29 are set to the same shape, the following description relates to the roller 28.

A method for setting the shape of the roller 28 will be described in which the large end face 7*a* of the tapered roller 7 has a diameter φDw1 and in which a small end face 7*b* of the tapered roller 7 has a diameter φdw1. The tapered roller 7 is hereinafter sometimes referred to as the "first workpiece 7". The peripheral velocity $V_{(Dw1)}$ on the large end face 7*a* (diameter φDw1) of the tapered roller 7 is as represented by Expression (1). The peripheral velocity $V_{(dw1)}$ on the small end face 7*b* (diameter φdw1) is as represented by Expression (2). The number of rotations (the needed number of rotations) of the tapered roller 7 is denoted by nw.

$$V_{(Dw1)}=\pi\times Dw1\times nw \quad (1)$$

$$V_{(dw1)}=\pi\times dw1\times nw \quad (2)$$

To make the peripheral velocity at an outer peripheral edge of the large end face 7*a* of the tapered roller 7 equal to the peripheral velocity of the roller large-diameter portion 62, which contacts the outer peripheral edge, the number of rotations of the roller 28 is as represented by Expression (3).

$$nr=V_{(Dw1)}/(\pi\times\varphi Dr1) \quad (3)$$

In Expression (3), $V_{(Dw1)}$ is a value determined by Expression (1). The diameter of the roller large-diameter portion 62 is denoted by Dr1. The diameter Dr1 is the diameter of a portion of the roller large-diameter portion 62, which contacts the outer peripheral edge of the large end face 7*a* of the tapered roller 7.

When the number of rotations of the roller 28 is "nr", the diameter φdr1 of the roller small-diameter portion 61 is as represented by Expression (4) in order to make the peripheral velocity at the outer peripheral edge of the small end face 7*b* of the tapered roller 7 equal to the peripheral velocity of the roller small-diameter portion 61, which contacts the outer peripheral edge of the small end face 7*b*. The diameter φdr1 is the diameter of a portion of the roller small-diameter portion 61, which contacts the outer peripheral edge of the small end face 7*b*.

$$\varphi dr1=V_{(dw1)}/(nr\times\pi) \quad (4)$$

In Expression (4), $V_{(dw1)}$ is a value determined by Expression (2) and nr is a value determined by Expression (3).

Thus, setting the shape of the roller 28 as described above eliminates the difference in peripheral velocity between the roller 28 and the tapered roller 7 (first workpiece 7). The roller 28 (29) having no difference in peripheral velocity from the first workpiece 7 is hereinafter referred to as the first roller 28 (29).

When the size (bearing number) of the tapered roller 7 is changed, the resultant tapered roller 7 and the roller 28 (29) are brought into linear contact with each other. To eliminate the difference in peripheral velocity between the roller 28 (29) and the tapered roller 7, the outer peripheral surface of the roller 28 (29) needs to be reshaped. The reshaping of the roller 28 (29) will be described. A case will be described where the first workpiece 7 is changed into a second workpiece 7. The second workpiece 7 is the tapered roller 7 in which the large end face 7*a* has a diameter φDw2 (<φDw1) and in which the small end face 7*b* has a diameter φdw2 (<φdw1) as depicted in FIG. 7.

In this case, the outer peripheral surface of the first roller 28 (29) is ground so as to form a second roller 28 (29) with a predetermined shape. In the present embodiment, the outer peripheral surface is ground so as to reduce the diameter of the roller small-diameter portion 61, with the diameter (φDr1) of the roller large-diameter portion 62 of the first roller 28 unchanged. Thus, the shape of the roller small-diameter portion 61 (diameter φdr2) is arithmetically determined, which allows elimination of the difference in peripheral velocity between the roller small-diameter portion 61 and the second roller 28 (29).

The peripheral velocity $V_{(Dw2)}$ on the large end face 7*a* (diameter φDw2) of the second workpiece 7 is as represented by Expression (5). The peripheral velocity V (dw2) on the small end face 7*b* (diameter φdw2) is as represented by Expression (6). The number of rotations (the needed number of rotations) of the second workpiece 7 is denoted by nw.

$$V_{(Dw2)}=\pi\times Dw2\times nw \quad (5)$$

$$V_{(dw2)}=\pi\times dw2\times nw \quad (6)$$

To make the peripheral velocity at an outer peripheral edge of the large end face 7*a* of the second workpiece 7 equal to the peripheral velocity of the roller large-diameter portion 62, which contacts the outer peripheral edge of the large end face 7*a*, the number of rotations nr of the second roller 28 is as represented by Expression (7).

$$nr=V_{(Dw2)}/(\pi\times\varphi Dr2) \quad (7)$$

In Expression (7), $V_{(Dw2)}$ is a value determined by Expression (5). The diameter of the roller large-diameter portion 62 is denoted by Dr2. In the present embodiment, φDr2 is the same as φDr1 (φDr2=φDr1).

When the number of rotations of the second roller 28 is "nr", the diameter φdr2 of the roller small-diameter portion 61 is as represented by Expression (8) in order to make the peripheral velocity at the outer peripheral edge of the small end face 7*b* of the second workpiece 7 equal to the peripheral velocity of the roller small-diameter portion 61 of the second roller 28, which contacts the outer peripheral edge of the small end face 7*b*.

$$\varphi dr2=V_{(dw2)}/(nr\times\pi) \quad (8)$$

In Expression (8), $V_{(dw2)}$ is a value determined by Expression (6). A value determined by Expression (7) is denoted by nr.

As described above, when the workpiece to be machined is changed to the second workpiece 7 with a different size, the diameter φdr2 of the roller small-diameter portion 61 can be determined through calculations to eliminate the difference in peripheral velocity between the second workpiece 7 and the second roller 28.

A taper angle of the second roller 28 can be determined through calculations based on a contact length between the second workpiece 7 and the second roller 28 in the axial direction and the diameters φDr2 and φdr2 of the second roller 28. The shape of the second roller 28 is determined, which is needed when the workpiece to be machined is changed to the second workpiece 7. The original first roller 28 (29) is removed from the machining apparatus 10. The second roller 28 (29) ground into the determined shape is assembled into the machining apparatus 10.

The shapes of the second workpiece 7 and the second rollers 28 and 29 have been determined. Thus, the following are determined through geometric calculations: the tilt angles θv (see FIG. 3) of the rollers 28 and 29; the lateral distance between the rollers 28 and 29 (namely, the lateral distance B between the support main body portions 43*a* and 44*a*: see FIG. 4); and the opening angle θh (see FIG. 4) between the centerlines L1 and L2 of the rollers 28 and 29, which are needed for bringing the second rollers 28 and 29 into linear contact with tapered roller 7 (second workpiece 7) set in a predetermined orientation during the above-described assembly. When the size of the tapered roller 7 is changed, the tilt angles θv of the rollers 28 and 29, the lateral distance (the distance B) between the rollers 28 and 29, and the opening angle θh between the centerlines L1 and L2 of the rollers 28 and 29 need to be changed (adjusted). However, to achieve this change (adjustment), the tapered roller 7 is positioned using, as a reference, the contact plane (horizontal plane) between the grinding stone 11 and the outer peripheral surface 8 of the tapered roller 7 in the present embodiment. To arrange the second rollers 28 and 29 so as to allow the second rollers 28 and 29 to linearly contact the tapered roller 7, the above-described values (θv, B, and θh) are determined through calculations including a combination of trigonometric functions based on the (determined) taper angles of the second rollers 28 and 29 and the like.

Then, the first adjustment portion 51 and the second adjustment portion 52 may be used to adjust the orientation and arrangement of the second rollers 28 and 29 so as to reproduce the determined tilt angles θv, the distance B, and the opening angle θh. In other words, to reproduce the tilt angles θv, the distance B, and the opening angle θh, the tilting adjustment unit 51*z* (see FIG. 3), the angular adjustment units 52*x* (see FIG. 4), and the distance adjustment unit 52*y* (see FIG. 4) may be set to predetermined lengths to adjust the orientation and arrangement of the support main body portions 43*a* and 44*a* and the installation members 43*b* and 44*b*, on which the rollers 28 and 29 are mounted.

When the machining apparatus 10 is used over a long period to machine the tapered rollers 7, the outer peripheral surfaces of the rollers 28 and 29 are worn away. In this case, the shape of the tapered roller 7 is not changed, but maintenance needs to be executed on the outer peripheral surfaces of the rollers 28 and 29 in order to keep an appropriate line contact state. In other words, the outer peripheral surfaces of the rollers 28 and 29 need to be ground into predetermined shapes to adjust the orientation and arrangement of the rollers 28 and 29 in the machining apparatus 10. Since the outer peripheral surfaces of the rollers 28 and 29 are shaped like truncated cones, a general grinder may be used, and grinding operations are easy.

Figure 8:
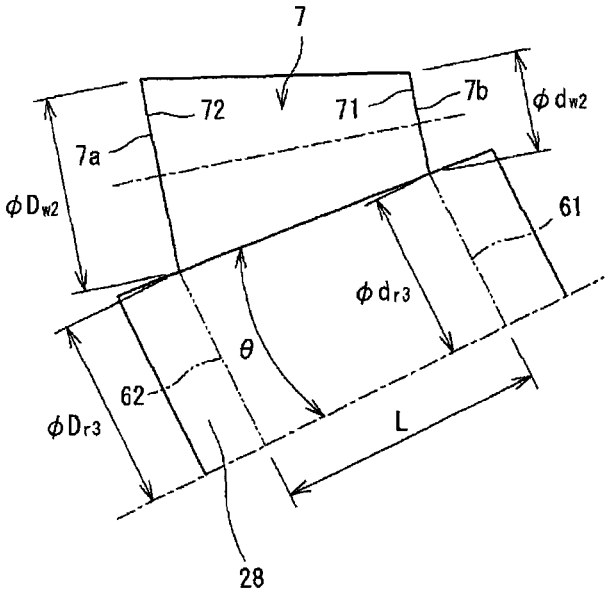
FIG. 8 is a diagram for illustrating the tapered roller and the rollers on which the tapered roller is mounted.
Figure 9:
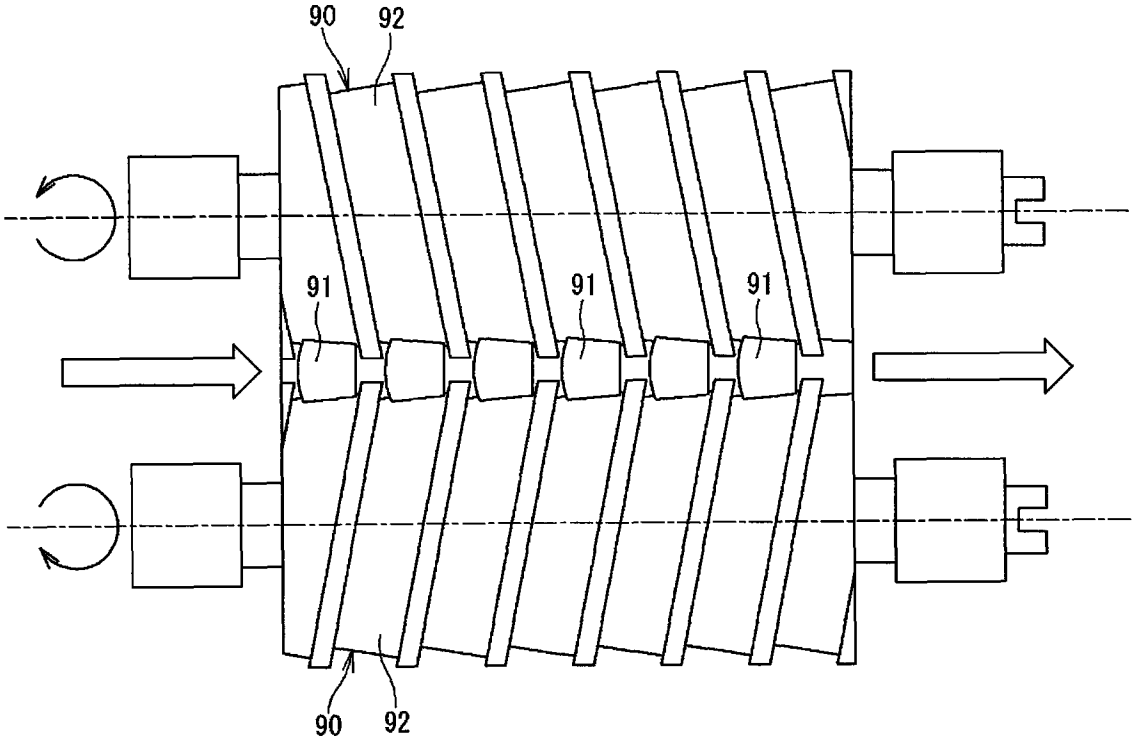
FIG. 9 is a plan view depicting a conventional machining apparatus.

For example, as described above, super-finishing is performed by rotating the second workpiece 7 using the second roller 28 (29). The diameters of the portions (the roller large-diameter portion 62 and the roller small-diameter portion 61) of the second roller 28 (29) are assumed to have decreased due to wear as the second workpieces 7 have been machined one after another. As depicted in FIG. 8, when the diameter of the roller large-diameter portion 62 is reduced to "φDr3 (<φDr2)", the diameter "φdr3" of the roller small-diameter portion 61 is arithmetically determined as described below, which diameter allows elimination of the difference in peripheral velocity between the roller 28 (29) and the second workpiece 7. The following description also relates to the roller 28.

In this case, the number of rotations n of a third roller 28 with the roller large-diameter portion 62 with a diameter φDr3 has a value determined by Expression (9).

$$n=V_{(Dw2)}/(\pi\times\varphi Dr3) \quad (9)$$

In Expression (9), $V_{(Dw2)}$ is a peripheral velocity $V_{(Dw2)}$ on the large end face 7*a* (diameter φDw2) of the second workpiece 7, and is a value determined by Expression (5). The diameter of the roller large-diameter portion 62 is denoted by φDr3.

When the number of rotations of the roller 28 is "n", the diameter φdr3 of the roller small-diameter portion 61 is as determined by Expression (10) in order to make a peripheral velocity at the outer peripheral edge of the small end face 7*b* of the tapered roller 7 (second workpiece 7) equal to a peripheral velocity of the roller small-diameter portion 61, which contacts the outer peripheral edge of the small end face 7*b*. The diameter φdr3 is the diameter of a portion of the roller small-diameter portion 61, which contacts the outer peripheral edge of the small end face 7*b*.

$$\varphi dr3=V_{(dw2)}/(n\times\pi) \quad (10)$$

In Expression (10), $V_{(dw2)}$ is a peripheral velocity $V_{(dw2)}$ on the small end face 7*b* (diameter φdw2) of the second workpiece 7, and is a value determined by Expression (6). A value determined by Expression (9) is denoted by n.

When the diameter of the roller 28 is changed as described above, the diameter φdr3 of the roller small-diameter portion 61 is determined through calculations in order to eliminate the difference in peripheral velocity between the second roller 28 and the second workpiece 7. A taper angle θ of the third roller 28 can be determined through calculations based on a contact length L between the third roller 28 and the second workpiece 7 in the axial direction and the diameters φDr3 and φdr3 of the third roller 28. This determines the shape of the third roller 28 for eliminating the difference in peripheral velocity from the second workpiece 7. The original second roller 28 (29) is removed from the machining apparatus 10. The third roller 28 (29) ground into the determined shape is assembled into the machining apparatus 10.

The shapes of the second workpiece 7 and the second rollers 28 and 29 have been determined. Thus, the following are determined through geometric calculations: the tilt angles θv (see FIG. 3) of the rollers 28 and 29; the lateral distance between the rollers 28 and 29 (namely, the lateral distance B between the support main body portions 43*a* and 44*a*: see FIG. 4); and the opening angle θh (see FIG. 4) between the centerlines L1 and L2 of the rollers 28 and 29, which are needed for bringing the third rollers 28 and 29 into linear contact with tapered roller 7 (second workpiece 7) set in the predetermined orientation during the above-described assembly. In other words, when the second roller 28 is worn away and maintenance is performed on the second roller 28 to form the third roller 28, the tilt angles θv (see FIG. 3) of the rollers 28 and 29, the lateral distance (the distance B) between the rollers 28 and 29, and the opening angle θh between the centerlines L1 and L2 of the rollers 28 and 29 need to be changed (adjusted). However, to achieve this change (adjustment), the tapered roller 7 is positioned using, as a reference, the contact plane (horizontal plane) between the grinding stone 11 and the outer peripheral surface 8 of the tapered roller 7 in the present embodiment. To arrange the third rollers 28 and 29 so as to allow the third rollers 28 and 29 to linearly contact the tapered roller 7, the above-described values (θv, B, and θh) are determined through calculations including a combination of trigonometric functions based on the (determined) taper angles θv of the third rollers 28 and 29 and the like.

The first adjustment portion 51 and the second adjustment portion 52 may be used to adjust the orientation and arrangement of the third rollers 28 and 29 so as to reproduce the determined tilt angles θv, the distance B, and the opening angle θh. In other words, to reproduce the tilt angles θv, the distance B, and the opening angle θh, the tilting adjustment unit 51*z* (see FIG. 3), the angular adjustment units 52*x* (see FIG. 4), and the distance adjustment unit 52*y* (see FIG. 4) may be set to predetermined lengths to adjust the orientation and arrangement of the support main body portions 43*a* and 44*a* and the installation members 43*b* and 44*b*, on which the rollers 28 and 29 are mounted.

As described above, even when the size (bearing number) of the tapered roller 7 is changed or the rollers 28 and 29 are worn away, the machining apparatus 10 in the present embodiment arithmetically determines the shapes of rollers 28 and 29 and machines (grinds) the rollers 28 and 29 into the determined shapes in order to reduce (eliminate) the difference in peripheral velocity between the tapered roller 7 and the rollers 28 and 29. The machining apparatus 10 facilitates setting of the tilts (θv) of the rollers 28 and 29 and the relative position (the lateral distance (B) and the opening angle (θh)) between the rollers 28 and 29). Thus, machining of the tapered roller 7 by the machining apparatus 10 can be quickly resumed. In other words, the machining apparatus 10 in the present embodiment can easily deal with a change in size of the tapered roller 7 compared to the machining apparatus according to the related art. Consequently, after maintenance is performed on the rollers 28 and 29, recovery can be quickly achieved. The difference in peripheral velocity between the tapered roller 7 and the rollers 28 and 29 are reduced (eliminated) so that a possible slip between the tapered roller 7 and the rollers 28 and 29 can be suppressed. As a result, the outer peripheral surface 8 of the tapered roller 7 can be prevented from being damaged by the grinding stone 11 due to a slip.

In the present embodiment, the tapered roller 7 and the rollers 28 and 29 are in linear contact with one another to enhance machining efficiency. The machining apparatus 10, which is of the in-feed type, allows the quality of the machined tapered roller 7 to be easily checked and a defect rate to be kept low. In the case of through-feed machining apparatuses, when some of the machined tapered rollers are found to be defective, in spite of the subsequent stoppage of the machining apparatus, a plurality of tapered rollers (workpieces) is already being machined and is likely to be also defective. However, the in-feed machining apparatus as in the present embodiment enables the defect rate to be minimized.

In the present embodiment, even when the size of the tapered roller 7 is changed or maintenance is performed on the rollers 28 and 29, the contact plane between the outer peripheral surface 8 of the tapered roller 7 and the grinding stone 11 is kept horizontal without any change in the orientation of the tapered roller 7, whereas the rollers 28 and 29 are tilted (the tilt angles and the like are changed). Thus, no change is made to a flow line of the tapered roller 7, which is a workpiece to be machined. The flow line of the tapered roller 7 can be shortened by transferring the tapered roller 7 substantially in a straight line along the front-rear direction. As a result, the cycle time of the machining can be shortened, thereby improving productivity. Even with a change of the size of the tapered roller 7 or the like, the contact plane between the outer peripheral surface 8 of the tapered roller 7 and the grinding stone 11 is kept horizontal. Thus, the direction in which the grinding stone 11 is vibrated may be kept horizontal, enabling simplification of the mechanism for vibrating the grinding stone 11 and of the adjustment of orientation of the grinding stone 11. The tapered roller 7 can be positioned with reference to the grinding stone 11 (the contact plane between the grinding stone 11 and the outer peripheral surface 8). This facilitates maintenance and management of dimensional accuracy for machining.

In the present embodiment, the swing center of the table 40 lies closer to the large end face 7*a* of the tapered roller 7. Thus, for example, when maintenance of the rollers 28 and 29 leads to a difference in size, the orientation of the rollers 28 and 29 needs to be adjusted as described above. The above-described values (θv, B, and θh) for the adjustment need to be determined through calculations including a combination of trigonometric functions. However, since the swing center of the table 40 lies closer to the large end face 7*a* of the tapered roller 7, the geometric configuration of the tapered roller 7 and the rollers 28 and 29 can be made as simple as possible. As a result, the above-described calculations can be easily executed.

The machining apparatus according to the invention is not limited to the illustrated form but may be in any other form within the scope of the invention. For example, the vibrating mechanism 17 that vibrates the grinding stone 11 may have a configuration different from the illustrated configuration.

The first adjustment portion 51 and the second adjustment portion 52 may have configurations other than the illustrated configurations.

The invention enables a reduction in the difference in peripheral velocity between the corresponding portions of the pair of rollers and the tapered roller. This allows suppression of a possible (sudden) slip between the pair of rollers and the tapered roller. As a result, the outer peripheral surface of the tapered roller can be prevented from being damaged as a result of a slip during machining.

What is claimed is:

1. An in-feed machining apparatus configured to machine an outer peripheral surface of a rotating tapered roller, the machining apparatus comprising:

a rotating mechanism having a lateral pair of rollers on which the tapered roller is mounted, the rotating mechanism rotating the pair of rollers;

a grinding stone that is brought into contact with the outer peripheral surface of the tapered roller mounted on the pair of rollers; and a mechanism configured to adjust relative positions between the tapered roller and the pair of rollers, the mechanism adjusting at least one of a tilt angle of the pair of rollers relative to a horizontal line, a lateral distance between the pair of rollers, and an opening angle between centerlines of the pair of rollers by independently moving each of the pair of rollers, so as to adjust the at least one of the tilt angle of both of the pair of rollers, the lateral distance of both of the pair of rollers, and the opening angle of both of the pair of rollers, wherein each roller of the pair of rollers is shaped like a truncated cone, small-diameter portions of the pair of rollers come into contact with a small-diameter portion of the tapered roller, and large-diameter portions of the pair of rollers come into contact with a large-diameter portion of the tapered roller.

2. The machining apparatus according to claim 1, wherein the machining apparatus includes, as the mechanism configured to adjust relative positions between the tapered roller and the pair of rollers, a table on which the pair of rollers is mounted and a fixed portion that supports the table so as to allow the table to swing forward and rearward around the tapered roller side.

3. The machining apparatus according to claim 1, wherein the machining apparatus includes, as the mechanism configured to adjust relative positions between the tapered roller and the pair of rollers, a first support portion that is movable in a lateral direction together with one roller of the pair of rollers and a second support portion that is movable in the lateral direction together with the other roller of the pair of rollers.

4. The machining apparatus according to claim 2, wherein the machining apparatus includes, as the mechanism configured to adjust relative positions between the tapered roller and the pair of rollers, a first support portion that is movable in a lateral direction together with one roller of the pair of rollers and a second support portion that is movable in the lateral direction together with the other roller of the pair of rollers.

5. The machining apparatus according to claim 1, wherein the machining apparatus includes, as the mechanism configured to adjust relative positions between the tapered roller and the pair of rollers, a first installation member on which one roller of the pair of rollers is rotatably installed and a second installation member on which the other roller of the pair of rollers is rotatably installed, and the first installation member and the second installation member are allowed to swing around a swing centerline that is orthogonal to centerlines of the pair of rollers and that extends along an imaginary vertical plane.

6. The machining apparatus according to claim 2, wherein the machining apparatus includes, as the mechanism configured to adjust relative positions between the tapered roller and the pair of rollers, a first installation member on which one roller of the pair of rollers is rotatably installed and a second installation member on which the other roller of the pair of rollers is rotatably installed, and the first installation member and the second installation member are allowed to swing around a swing centerline that is orthogonal to centerlines of the pair of rollers and that extends along an imaginary vertical plane.

7. The machining apparatus according to claim 3, wherein the machining apparatus includes, as the mechanism configured to adjust relative positions between the tapered roller and the pair of rollers, a first installation member on which one roller of the pair of rollers is rotatably installed and a second installation member on which the other roller of the pair of rollers is rotatably installed, and the first installation member and the second installation member are allowed to swing around a swing centerline that is orthogonal to centerlines of the pair of rollers and that extends along an imaginary vertical plane.

8. The machining apparatus according to claim 4, wherein the machining apparatus includes, as the mechanism configured to adjust relative positions between the tapered roller and the pair of rollers, a first installation member on which one roller of the pair of rollers is rotatably installed and a second installation member on which the other roller of the pair of rollers is rotatably installed, and the first installation member and the second installation member are allowed to swing around a swing centerline that is orthogonal to centerlines of the pair of rollers and that extends along an imaginary vertical plane.

9. The machining apparatus according to claim 2, wherein the machining apparatus includes, as the mechanism configured to adjust relative positions between the tapered roller and the pair of rollers, an adjustment unit that is interposed between the fixed portion and the table, and that is configured to be extended and contracted to adjust the tilt angle of the pair of rollers relative to the horizontal line.

10. The machining apparatus according to claim 3, wherein the machining apparatus includes, as the mechanism configured to adjust relative positions between the tapered roller and the pair of rollers, an adjustment unit that is interposed between the first support portion and the second support portion, and that is configured to be extended and contracted to adjust the lateral distance between the pair of rollers.

11. The machining apparatus according to claim 5, wherein the machining apparatus includes, as the mechanism configured to adjust relative positions between the tapered roller and the pair of rollers, an adjustment unit that is interposed between one of the first and second installation members and a part of a table on which the pair of rollers is mounted, and that is configured to be extended and contracted to adjust the opening angle between the centerlines of the pair of rollers.

12. The machining apparatus according to claim 4, wherein the machining apparatus includes, as the mechanism configured to adjust relative positions between the tapered roller and the pair of rollers, an adjustment unit that is interposed between the fixed portion and the table, and that is configured to be extended and contracted to adjust the tilt angle of the pair of rollers relative to the horizontal line.

13. The machining apparatus according to claim 4, wherein the machining apparatus includes, as the mechanism configured to adjust relative positions between the tapered roller and the pair of rollers, an adjustment unit that is interposed between the first support portion and the second support portion, and that is configured to be extended and contracted to adjust the lateral distance between the pair of rollers.

14. The machining apparatus according to claim 6, wherein the machining apparatus includes, as the mechanism configured to adjust relative positions between the tapered roller and the pair of rollers, an adjustment unit that is interposed between the fixed portion and the table, and that is configured to be extended and contracted to adjust the tilt angle of the pair of rollers relative to the horizontal line.

15. The machining apparatus according to claim 6, wherein the machining apparatus includes, as the mechanism configured to adjust relative positions between the tapered roller and the pair of rollers, an adjustment unit that is interposed between one of the first and second installation members and a part of the table on which the pair of rollers is mounted, and that is configured to be extended and contracted to adjust the opening angle between the centerlines of the pair of rollers.

16. The machining apparatus according to claim 7, wherein the machining apparatus includes, as the mechanism configured to adjust relative positions between the tapered roller and the pair of rollers, an adjustment unit that is interposed between the first support portion and the second support portion, and that is configured to be extended and contracted to adjust the lateral distance between the pair of rollers.

17. The machining apparatus according to claim 7, wherein the machining apparatus includes, as the mechanism configured to adjust relative positions between the tapered roller and the pair of rollers, an adjustment unit that is interposed between one of the first and second installation members and a part of a table on which the pair of rollers is mounted, and that is configured to be extended and contracted to adjust the opening angle between the centerlines of the pair of rollers.

18. The machining apparatus according to claim 8, wherein the machining apparatus includes, as the mechanism configured to adjust relative positions between the tapered roller and the pair of rollers:

a first adjustment unit that is interposed between the fixed portion and the table, and that is configured to be extended and contracted to adjust the tilt angle of the pair of rollers relative to the horizontal line;

a second adjustment unit that is interposed between the first support portion and the second support portion, and that is configured to be extended and contracted to adjust the lateral distance between the pair of rollers; and a third adjustment unit that is interposed between one of the first and second installation members and a part of the table on which the pair of rollers is mounted, and that is configured to be extended and contracted to adjust the opening angle between the centerlines of the pair of rollers.

* * * * *